US011618059B2

(12) United States Patent
Ring

(10) Patent No.: US 11,618,059 B2
(45) Date of Patent: Apr. 4, 2023

(54) VERTICAL HIGH-PRESSURE RINSE MACHINE

(71) Applicant: FERMI RESEARCH ALLIANCE, LLC, Batavia, IL (US)

(72) Inventor: Timothy J. Ring, Saint Charles, IL (US)

(73) Assignee: Fermi Research Alliance, LLC, Batavia, IL (US)

( * ) Notice: Subject to any disclaimer, the term of this patent is extended or adjusted under 35 U.S.C. 154(b) by 408 days.

(21) Appl. No.: 16/880,636

(22) Filed: May 21, 2020

(65) Prior Publication Data

US 2020/0368790 A1 Nov. 26, 2020

Related U.S. Application Data

(60) Provisional application No. 62/851,096, filed on May 21, 2019.

(51) Int. Cl.

| | |
|---|---|
| ***B05B 9/01*** | (2006.01) |
| ***B05B 9/04*** | (2006.01) |
| ***B05B 12/32*** | (2018.01) |
| ***B05B 13/06*** | (2006.01) |
| ***B08B 3/02*** | (2006.01) |

(52) U.S. Cl.

CPC ..... *B08B 3/024* (2013.01); *B05B 9/01* (2013.01); *B05B 9/0403* (2013.01); *B05B 12/32* (2018.02); *B05B 13/069* (2013.01); *B05B 13/0609* (2013.01); *B05B 13/0636* (2013.01); *B08B 2203/0211* (2013.01)

(58) Field of Classification Search

None

See application file for complete search history.

(56) References Cited

U.S. PATENT DOCUMENTS

| | | | | |
|---|---|---|---|---|
| 6,878,189 | B2 | 4/2005 | Moredock | |
| 2012/0073461 | A1* | 3/2012 | Terada | B05C 13/00 101/484 |

* cited by examiner

*Primary Examiner* — Levon J Shahinian

(74) *Attorney, Agent, or Firm* — Loza & Loza, LLP; Kevin L. Soules

(57) ABSTRACT

A high-pressured rinsing system comprises a base including a liquid reservoir, a rotation motor housing including a rotation motor adapted to rotate a spray wand attached, and extending vertically upward from, the rotation motor housing and base, a linear rail support frame attached the base and including a vertical motor and associated linear rail attached thereto, a cavity mounting plate attached to the linear rail, wherein vertical movement of the linear rail causes vertical movement of the cavity mounting plate over the base; and at least one door and a plurality of side panels mounting to an enclosure support frame, wherein the enclosure support frame is mounted and secured to the linear rail support frame and base to create an enclosure around the spray wand and linear rail.

8 Claims, 19 Drawing Sheets

VERTICAL HIGH-PRESSURE RINSE MACHINE

CROSS REFERENCE TO RELATED PATENT APPLICATIONS

The present application claims the priority and benefit under 35 U.S.C. § 119(e) of U.S. Provisional Patent Application Ser. No. 62/851,096 filed May 21, 2019, entitled "VERTICAL HIGH-PRESSURE RINSE MACHINE." U.S. Provisional Patent Application Ser. No. 62/851,096 is herein incorporated by reference in its entirety.

STATEMENT OF GOVERNMENT RIGHTS

The invention described in this patent application was made with Government support under the Fermi Research Alliance, LLC, Contract Number DE-AC02-07CH11359 awarded by the U.S. Department of Energy. The Government has certain rights in the invention.

TECHNICAL FIELD

The embodiments are generally related to power washing and rinsing. More particularly, the embodiments are related to a vertical high-pressure rinse (HPR) machine adapted to cleanse and rinse inside surfaces of various shaped piping over an entire internal surface of the piping/tubing.

BACKGROUND

Some systems used in industrial processes need to be cleaned with pure liquids or solids for contamination removal. For example, nuclear particle accelerators employ cavities. Accelerator cavities are difficult to clean within the environment they operate. There is also the problem that cleaning equipment cannot be inserted into a clean room environment without the concern of contaminating the clean room environment.

What is needed in the art is an improved system for washing and/or rinsing equipment or products in controlled environments, for example to rinse surfaces or areas inside an enclosed cavity of an object, system, or tool.

SUMMARY

The following summary is provided to facilitate an understanding of some of the innovative features unique to the embodiments disclosed and is not intended to be a full description. A full appreciation of the various aspects of the embodiments can be gained by taking the entire specification, claims, drawings, and abstract as a whole.

It is a feature of the embodiments to provide a high-pressure rinse machine that is adapted to clean and/or rinse equipment including the inside cavity space of an object, product, or tool.

In accordance with a feature of the disclosed embodiments, a high-pressure rinsing system includes a motor and gearbox to rotate a spray wand and filter assembly that can be mounted to a rail system, allowing for the assembly to be relocated during loading and unloading of product, without disassembling the base.

In accordance with a feature of the disclosed embodiments, a linear rail support frame can be attached to the base, including a vertical motor and associated linear rail attached thereto, and a cavity mounting plate attached to the linear rail, wherein vertical movement of the linear rail causes vertical movement of the cavity mounting plate over the base.

In accordance with a feature of the disclosed embodiments, at least one door and a plurality of side panels mounted to an enclosure support frame can be provided, wherein said enclosure support frame is mounted and secured to the linear rail support frame and base to create a water tight enclosure around the spray wand and linear rail.

In accordance with another feature of the disclosed embodiments, the cavity mounting plate is further adapted to secure a subject cavity during vertical movement of the cavity mounting plate with the linear rail, during rinsing of the subject cavity, by the spray wand.

In accordance with yet another feature of the disclosed embodiments, the at least one door further comprises at least one handle. The handle is adapted for opening and closing the at least one door. At least one latch is adapted to keep the at least one door closed to create the water tight enclosure, wherein access to the cavity mounting plate is provided through the at least one door.

The aforementioned aspects and other objectives and advantages can now be achieved as described herein. In an exemplary embodiment, a high-pressure rinsing system, comprises a base including at least one of adjustable feet and/or wheels adapted to contact a floor, said base including a liquid reservoir for process water collection, a rotation motor housing including a rotation motor attached to a rotation gearbox, and a pump motor adapted to pump water from a through hose and rotary union to a filter housing through the rotation gearbox through a spray wand adapter base to a spray wand attached, and extending vertically upward from, the rotation motor housing and base, a linear rail support frame attached the base and including a vertical motor and associated linear rail attached thereto, wherein said vertical motor is adapted to move the linear rail, a cavity mounting plate attached to the linear rail, wherein vertical movement of the linear rail causes vertical movement of the cavity mounting plate, and at least one door and a plurality of side panels mounted to an enclosure support frame, wherein said enclosure support frame is engaged to the linear rail support frame and base to create an enclosure around the spray wand and the linear rail.

In an embodiment of the high-pressure rinse system, the cavity mounting plate is further adapted to be mounted to a subject cavity. In certain embodiments, the spray wand can be moved behind the cavity mounting plate to allow a cavity and cavity-holding frame to be installed or removed without removal of the spray wand. In certain embodiments the at least one door further comprises at least one handle adapted to open and close the at least one door and at least one latch to keep the at least one door closed to create the water tight enclosure. In certain embodiment the high-pressure rinsing further comprises a horizontal track and motor system adapted to facilitate forward and backward movement of the rotation motor housing and spray wand with respect to the cavity mounting plate position.

BRIEF DESCRIPTION OF THE FIGURES

The accompanying figures, in which like reference numerals refer to identical or functionally-similar elements throughout the separate views and which are incorporated in and form a part of the specification, further illustrate the embodiments and, together with the detailed description, serve to explain the embodiments disclosed herein.

DETAILED DESCRIPTION

Figure 1A:
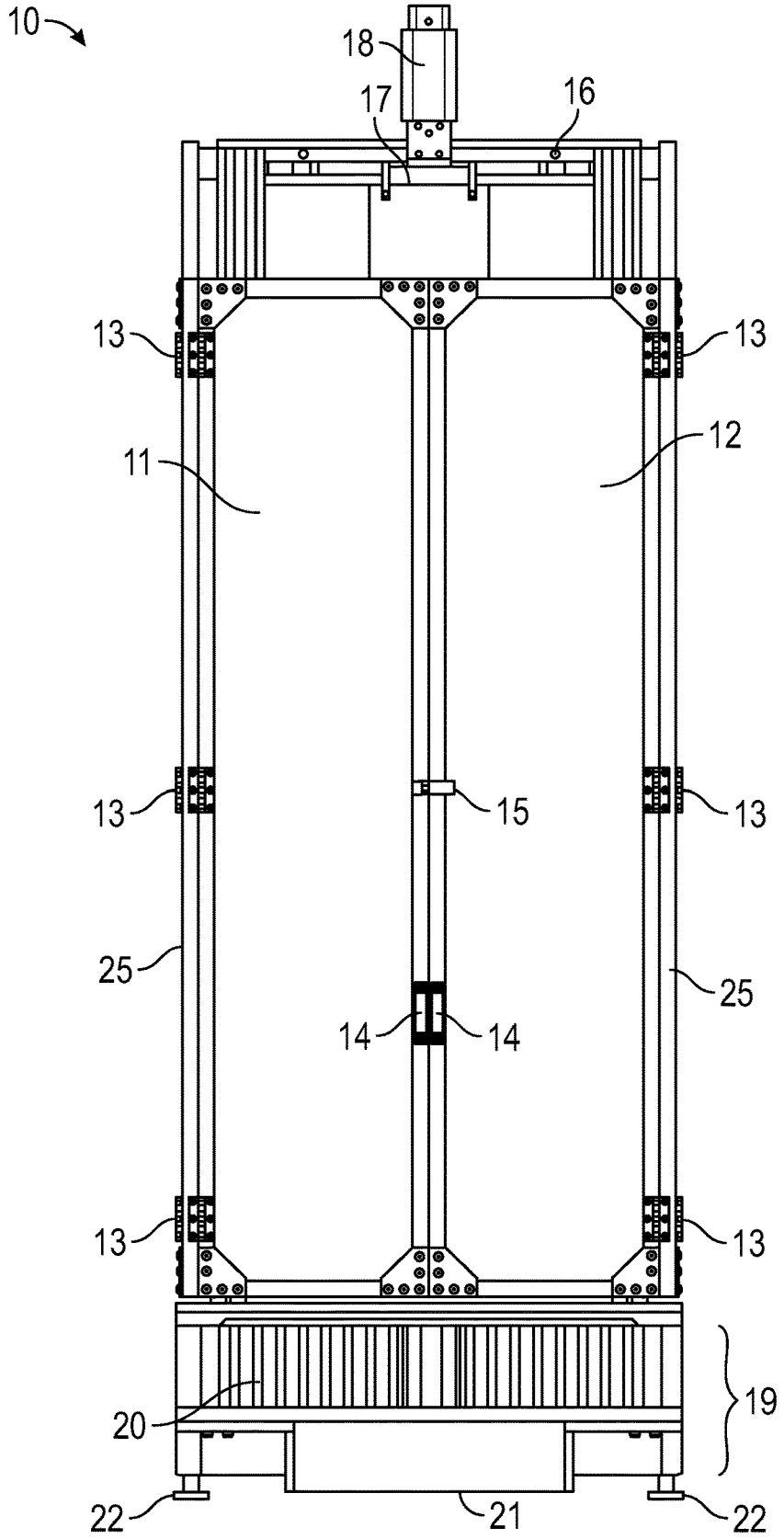
FIG. 1A illustrates aspects of a high-pressure rinse system, in accordance with features of the embodiments.

The particular values and configurations discussed in the following non-limiting examples can be varied, and are cited merely to illustrate one or more embodiments, and are not intended to limit the scope thereof.

Example embodiments will now be described more fully hereinafter with reference to the accompanying drawings, in which illustrative embodiments are shown. The embodiments disclosed herein can be embodied in many different forms and should not be construed as limited to the embodiments set forth herein. Rather, these embodiments are provided so that this disclosure will be thorough and complete, and will fully convey the scope of the embodiments to those skilled in the art. Like reference numerals refer to like elements throughout.

ELEMENT LIST

| Number | Identity |
|---|---|
| 10 | High-Pressure Rinse System |
| 11 | Left Door |
| 12 | Right Door |
| 13 | Hinge |
| 14 | Handle |
| 15 | Latch |
| 16 | Linear Rail Support Frame |
| 17 | Linear Rail |
| 18 | Vertical Motor |
| 19 | Base |
| 20 | Vent |
| 21 | Fluid Reservoir |
| 22 | Leveling Feet |
| 23 | Enclosure Support Frame |
| 24 | Side Panel |
| 25 | Panel Frame |
| 26 | Cavity-Mounting Plate |
| 27 | Subject Cavity |
| 28 | Cavity-Holding Frame |
| 29 | Tri-Clamp |
| 30 | Spray Wand |
| 31A | Rotation Motor Housing |
| 31B | Rotation Motor Housing Assembly |
| 32 | Splash Cover |
| 33A | Rotation Motor |
| 33B | Pump Motor |
| 34 | Water Filter |
| 35 | Fluid Supply Line Rotary Union |
| 36 | Spray Wand Adapter Plate |
| 37 | Bearing Mount Plate |
| 38 | Guide Rail Bearing |
| 39 | High-Pressure Hose Connector |
| 40 | Floor Grates |
| 41 | High-Pressure Hose |
| 42 | High-Pressure Hose Mount |
| 43 | Proximity Switch |
| 44 | Rotation Gear Box |
| 45 | Cavity Frame Clamp |
| 46 | Rotary Grip Assembly |
| 47 | Spring Plunger |
| 48 | Carriage Adapter Mount |
| 49 | Filter Frame |
| 50 | Filter |
| 51 | Tote Assembly |
| 52 | Operator Control Handle |
| 53 | Wheels |
| 54 | Horizontal Track and Motor System |

The terminology used herein is for the purpose of describing particular embodiments only and is not intended to be limiting. As used herein, the singular forms a, an, and the are intended to include the plural forms as well, unless the context clearly indicates otherwise. It will be further understood that the terms 'comprises and/or comprising, when used in this specification, specify the presence of stated features, integers, steps, operations, elements, and/or components, but do not preclude the presence or addition of one or more other features, integers, steps, operations, elements, components, and/or groups thereof.

Throughout the specification and claims, terms may have nuanced meanings suggested or implied in context beyond an explicitly stated meaning. Likewise, the phrase "in one embodiment as used herein does not necessarily refer to the same embodiment and the phrase "In another embodiment as used herein does not necessarily refer to a different embodiment. It is intended, for example, that claimed subject matter include combinations of example embodiments in whole or in part.

Unless otherwise defined, all terms (including technical and scientific terms) used herein have the same meaning as commonly understood by one of ordinary skill in the art. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

It is contemplated that any embodiment discussed in this specification can be implemented with respect to any method, kit, reagent, or composition of the invention, and vice versa. Furthermore, compositions of the invention can be used to achieve methods of the invention.

It will be understood that particular embodiments described herein are shown by way of illustration and not as limitations. The principal features can be employed in various embodiments without departing from the scope disclosed herein. Those skilled in the art will recognize, or be able to ascertain using no more than routine experimentation, numerous equivalents to the specific procedures described herein. Such equivalents are considered to be within the scope of the disclosed embodiments and are covered by the claims.

The use of the word "a" or "an" when used in conjunction with the term "comprising in the claims and/or the specification may mean "one," but it is also consistent with the meaning of "one or more," at "at least one," and "one or more than one." The use of the term "or" in the claims is used to mean "and/or" unless explicitly indicated to refer to alternatives only or the alternatives are mutually exclusive, although the disclosure supports a definition that refers to only alternatives and "and/or." Throughout this application, the term "about" is used to indicate that a value includes the inherent variation of error for the device, the method being employed to determine the value, or the variation that exists among the study subjects.

As used in this specification and claim(s), the words "comprising" (and any form of comprising, such as "comprise" and "comprises"), "having" (and any form of "having," such as "have" and "has"), "including" (and any form of "including," such as "includes" and "include") or "containing" (and any form of "containing," such as "contains" and "contain") are inclusive or open-ended and do not exclude additional, un-recited elements or method steps.

All of the compositions and/or methods disclosed and claimed herein can be made and executed without undue experimentation in light of the present disclosure. While the compositions and methods of this invention have been described in terms of preferred embodiments, it will be apparent to those of skill in the art that variations may be applied to the compositions and/or methods and in the steps, or in the sequence of steps, of the method described herein without departing from the concept, spirit and scope of the disclosed embodiments. All such similar substitutes and modifications apparent to those skilled in the art are deemed to be within the spirit, scope and concept as defined by the appended claims.

Figure 1B:
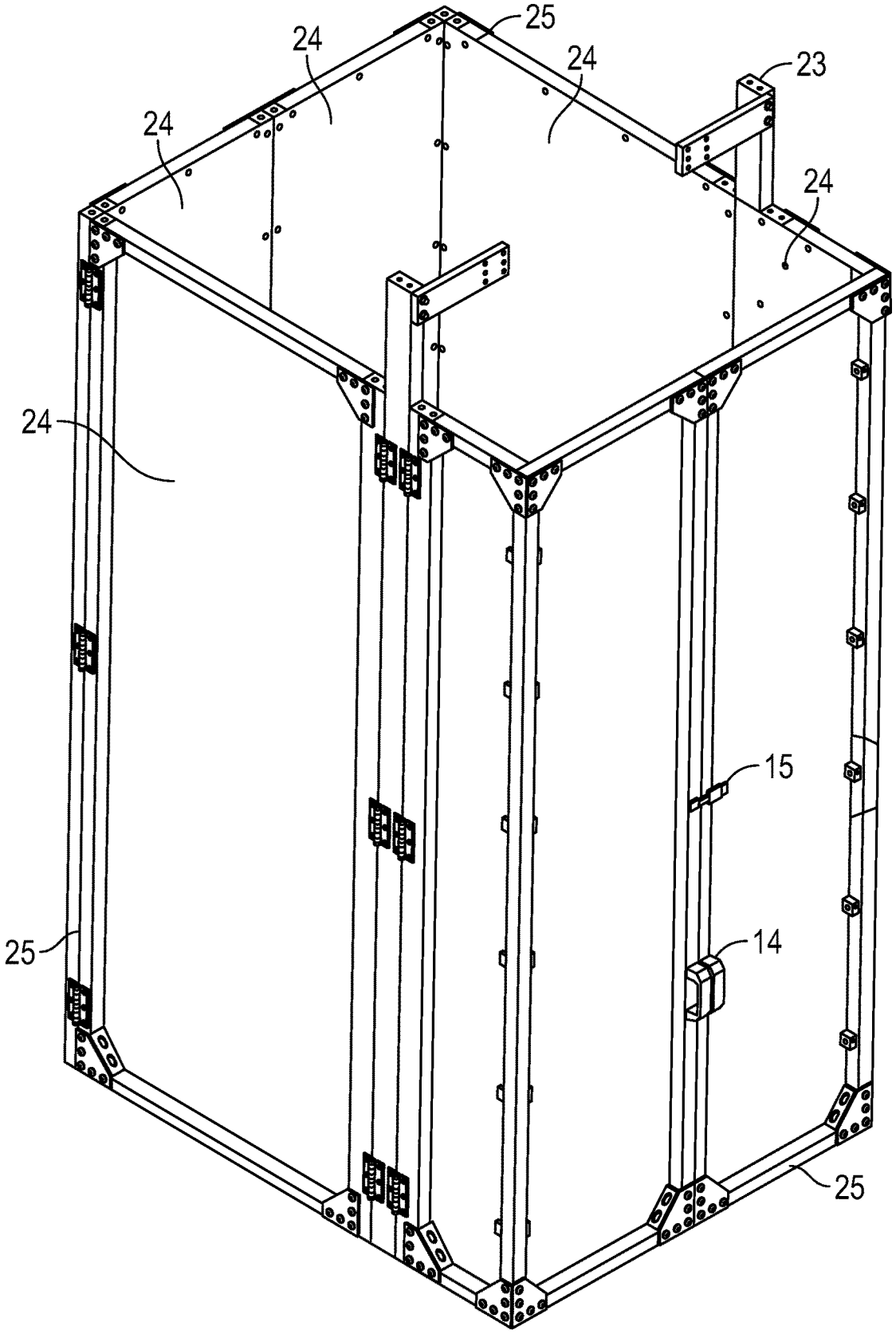
FIG. 1B illustrates aspects of a high-pressure rinse system, in accordance with features of the embodiments.
Figure 1C:
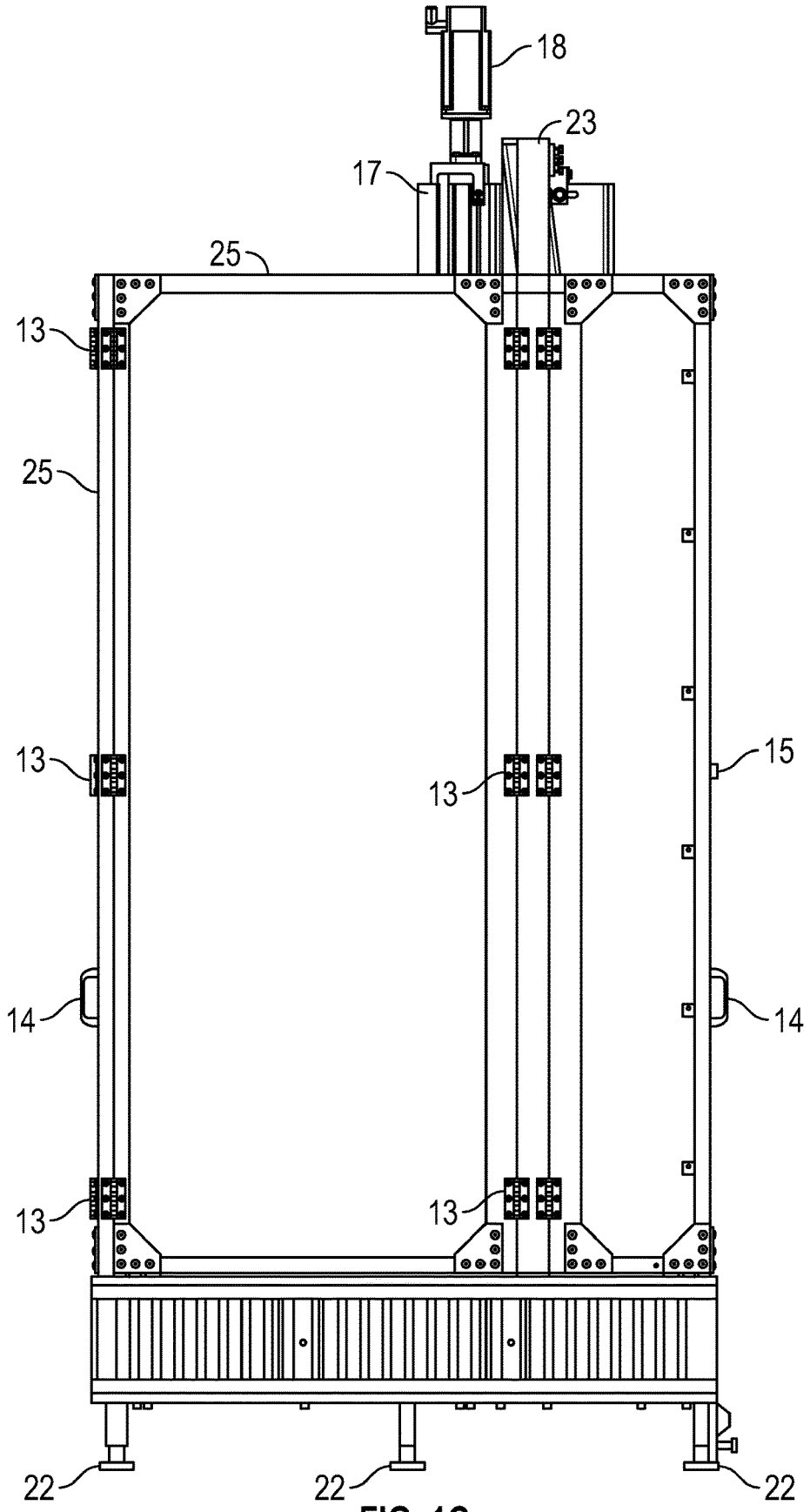
FIG. 1C illustrates aspects of a high-pressure rinse system, in accordance with features of the embodiments.

Referring to FIGS. 1A-1C, aspects of a high-pressure rinse system 10 are illustrated in accordance with features of the embodiments. A high-pressure rinse system 10 can include a left door 11 and right door 12 mounted to a panel frame 25 of the HPR system 10 with hinges 13. In certain embodiments, the doors 11 and 12 can be made of a transparent material so that operations inside the HPR system 10 are visible from the outside. It should be appreciated that in other embodiments there can be a single door (at least one door) to provide access inside the HPR system 10. Handles 14 enable opening of the door 11 and door 12 and a latch 15 can secure the door 11 and/or door 12 in a closed position.

The HPR system 10 can thus include a housing that is created by at least one door 11 and/or door 12 and panels 24. The frame 25 can be supported by a base 19. The base 19 can be further supported by adjustable feet 22, or wheels (not shown). A fluid reservoir 21 can be included at the bottom of the base 19 to capture fluid that is sprayed inside the HPR system 10 housing.

A vertical motor 18 can be mounted to a linear rail support frame 16. The vertical motor 18 controls vertical movement of a linear rail 17. An enclosure support frame 23 can secure the panel frame 25, associated panels 24, and door 11 and/or door 12, to the linear rail support frame 16, which can provide support for the HPR system 10 assembly.

Figure 2:
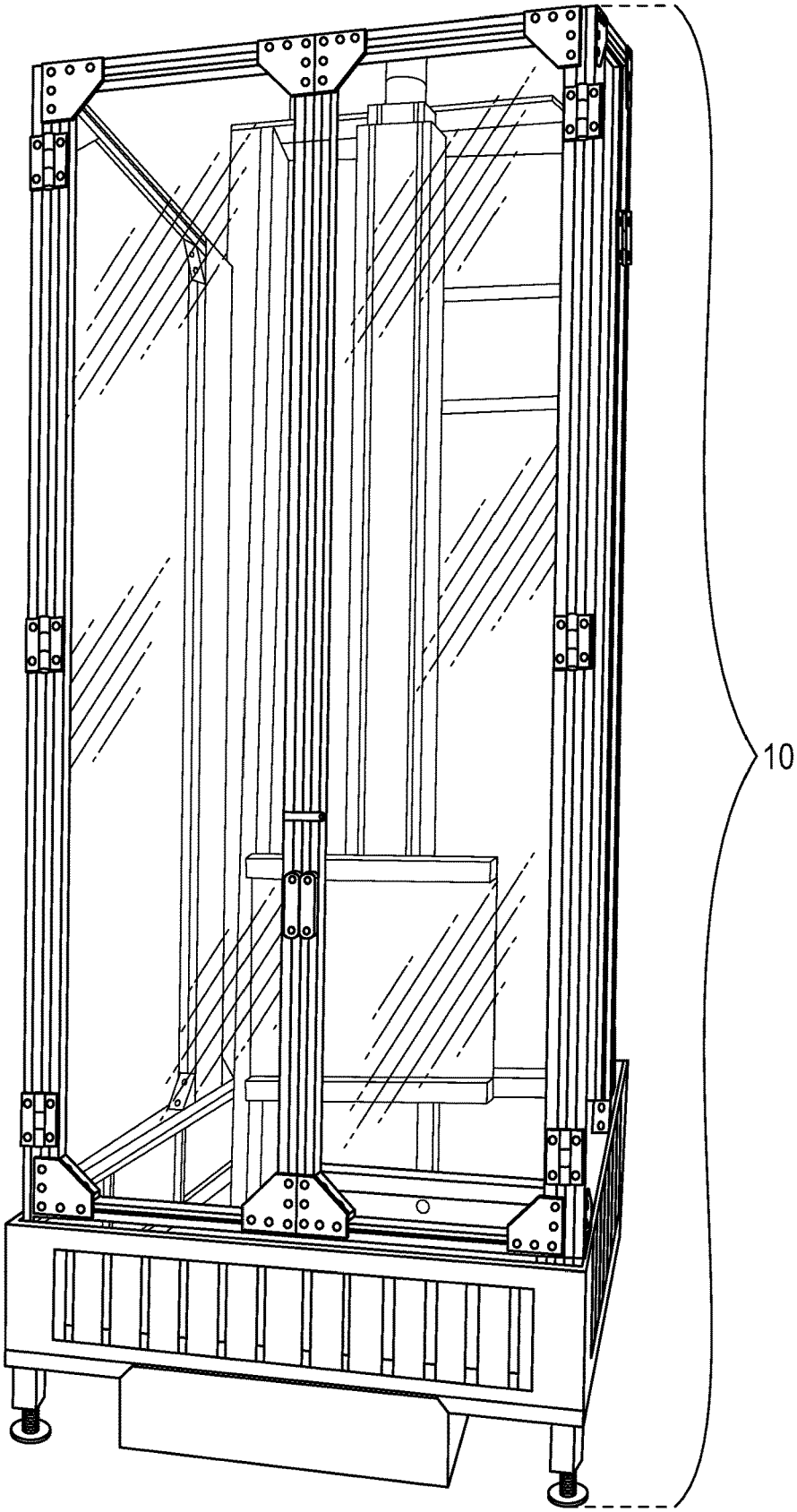
FIG. 2 illustrates an image of an exemplary view of a high-pressure rinse system, in accordance with features of the embodiments.

Referring to FIG. 2, an image is provided showing an exemplary perspective view of a high-pressure rinse system 10. An HPR system 10 will look similar to a booth in appearance when fully assembled.

Figure 3A:
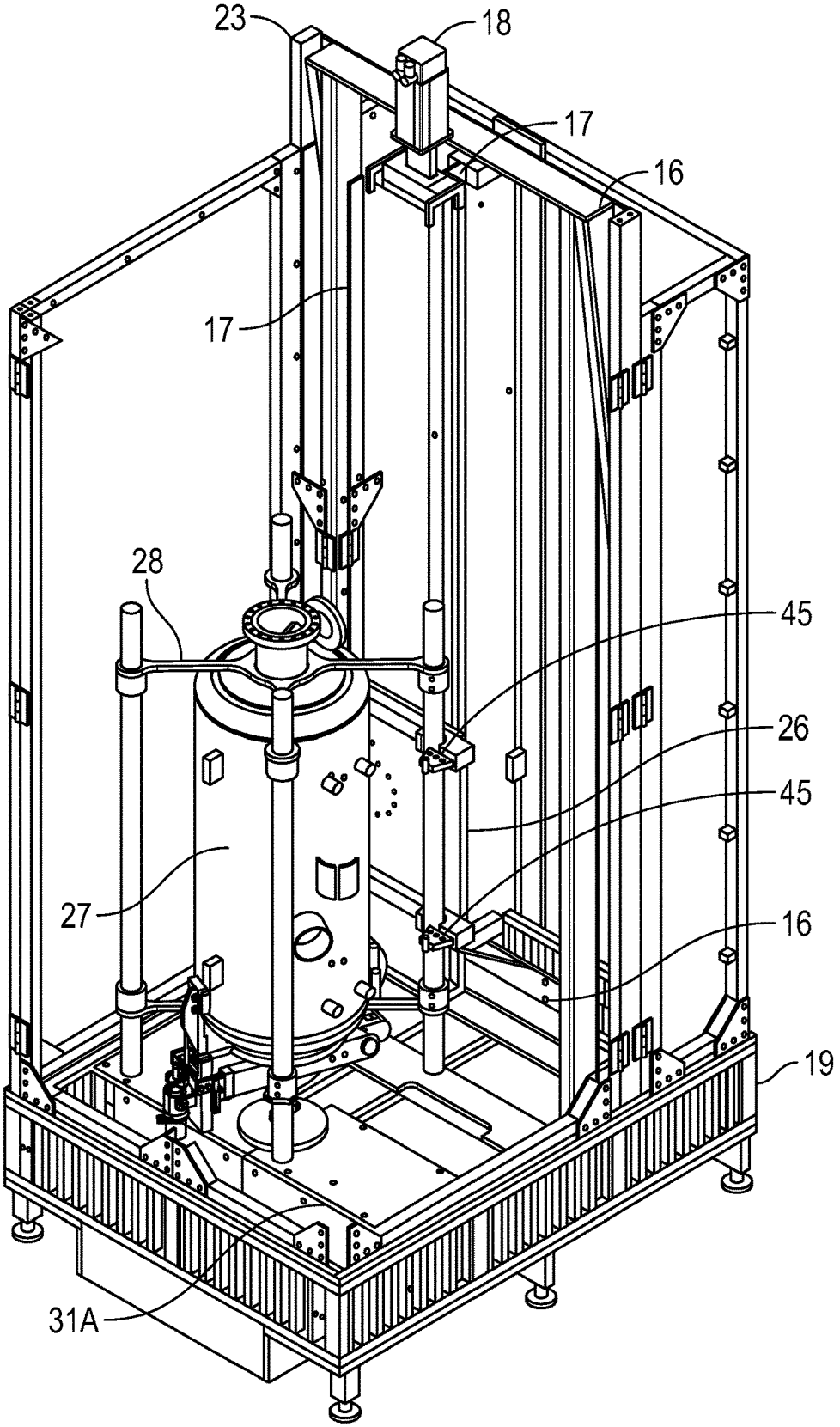
FIG. 3A illustrates aspects of a high-pressure rinse system including an accelerator cavity, as an example product, contained within an enclosure of the high-pressure rinse system, in accordance with features of the embodiments.
Figure 3B:
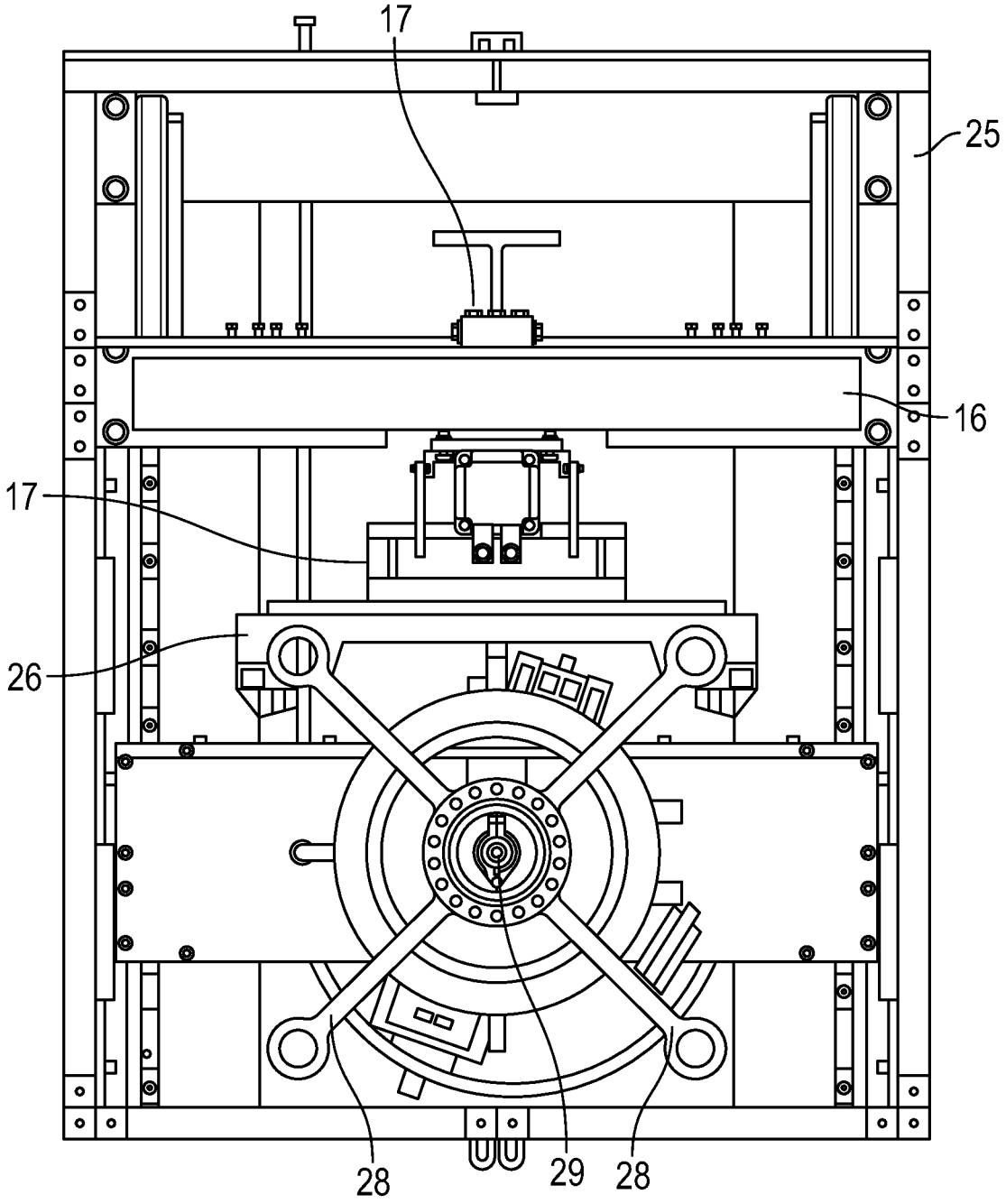
FIG. 3B illustrates aspects of a high-pressure rinse system including an accelerator cavity, as an example product, contained within an enclosure of the high-pressure rinse system, in accordance with features of the embodiments.

FIGS. 3A-3B illustrate internal aspects of an HPR system 10 and a subject cavity 27 as an example product that can be placed in, temporarily contained by, and cleaned with, the HPR system 10, in accordance with features of the embodiments. The accelerator cavity 27 can be secured to a cavity mounting plate 26 by a cavity-holding frame 28 that can be assembled (in some cases temporarily) around the subject cavity 27. The cavity-holding frame 28 can also be secured to the subject cavity 27 by a cavity lock 29. Then the cavity-holding frame 28, and subject cavity 27, can be secured to cavity mounting plate 26 by cavity frame clamps 45. The cavity-holding frame 28 and cavity mounting plate 26 secure the subject cavity 27 as it is being moved up and down the linear rail 17 by the vertical motor 18.

Figure 4A:
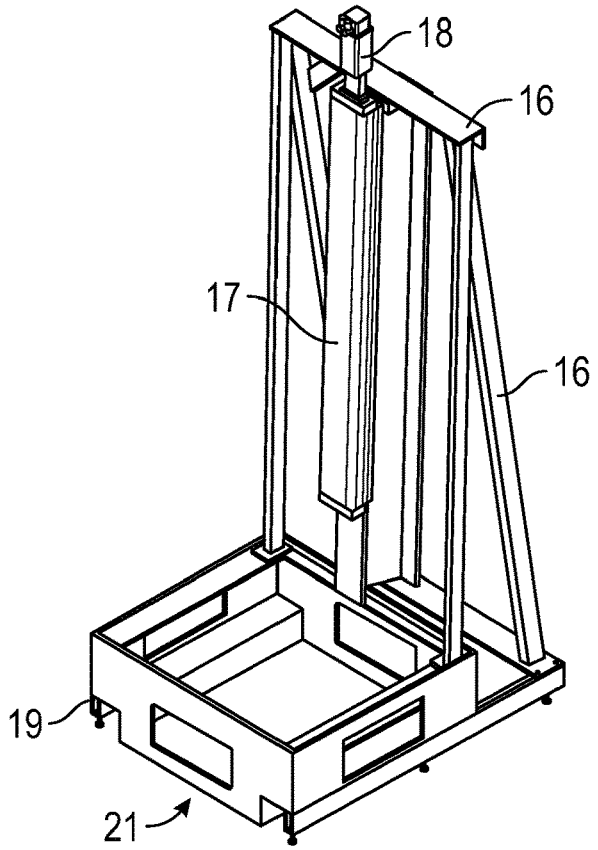
FIG. 4A illustrates a linear rail support frame with a linear rail, in accordance with features of the embodiments.
Figure 4B:
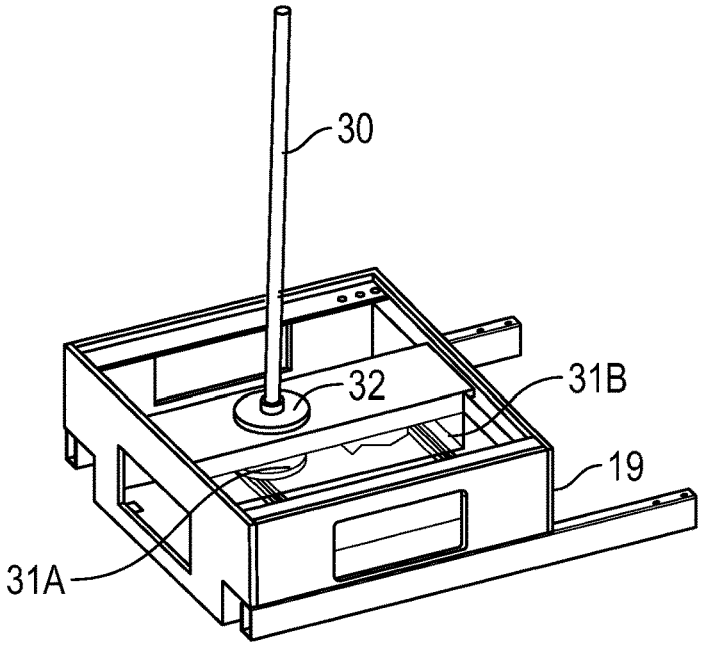
FIG. 4B illustrates a linear rail support frame with a linear rail and spray wand, in accordance with features of the embodiments.

FIGS. 4A-4B, illustrate a linear rail support frame 16 with the linear rail 17 with vertical motor 18 attached, and a spray wand 30 extending from the base 19, in accordance with features of the embodiments. The linear rail support frame 16 is shown interfacing with, and secured to, the base 19. A spray wand 30 and associated rotation motor housing assembly 31B, can be installed within the base 19. The location of a water reservoir 21 is indicated in the drawing as being in an area below openings that can serve as vents.

The spray wand 30 is shown extending upward from its interface with a splash cover 32 located on top of the rotation motor housing 31A. The splash cover 32 minimizes penetration of liquid into the rotation motor housing 31A during circular rotation of the spray wand 30 and while rotating, provides a signal source for the proximity switch 43.

In general, the subject cavity 27 can be mounted to the linear rail support frame 16 with an open end of the cavity 27 arranged above the spray wand 30. The vertical motor 18 can then be used to lower the cavity 27 over the spray wand 30 so that the spray wand 30 is inside the cavity 27. The spray wand 30 can be rotated by the rotation motor 33A, and cleaning fluid can be delivered to the spray wand 30 via the pump motor 33B. It should be appreciated that in certain embodiments the pump motor can comprise an external pump motor assembly and pump motor housing that pumps cleaning fluid at high pressure to the wand 30. The spray wand 30 can spray the cleaning fluid onto the internal surfaces of the subject cavity 27 to clean the surfaces.

Figure 5A:
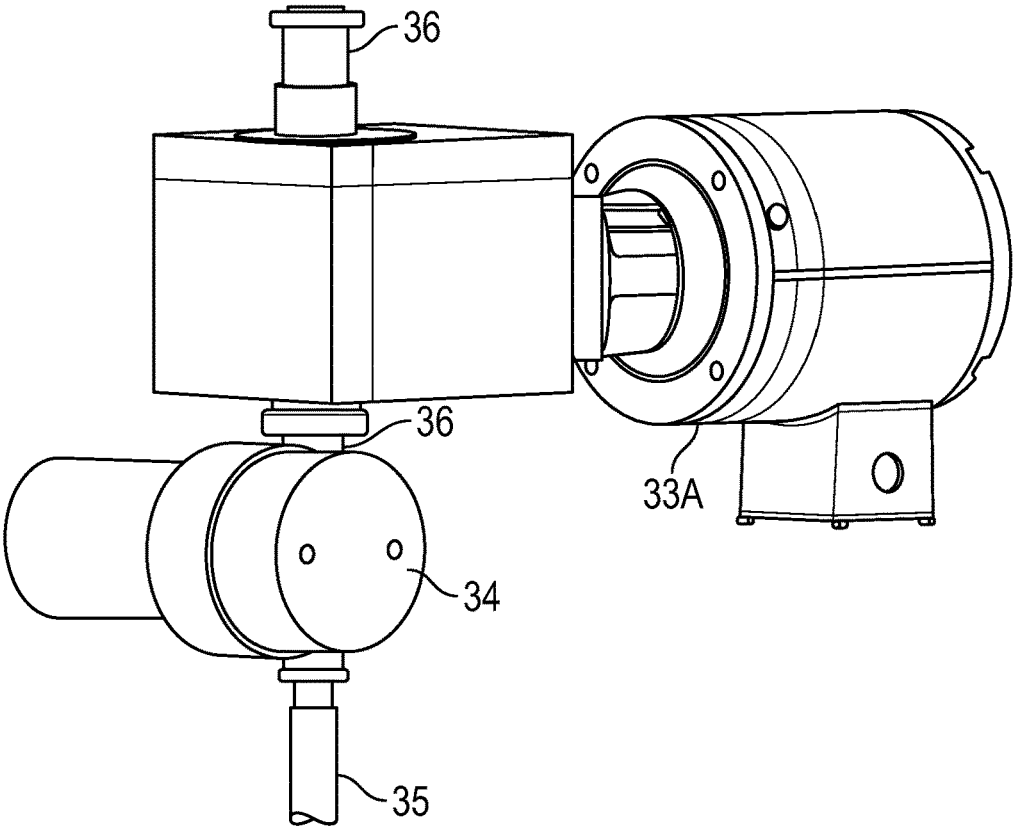
FIG. 5A illustrates a filter interfacing with a fluid supply line, in accordance with features of an embodiment.
Figure 5B:
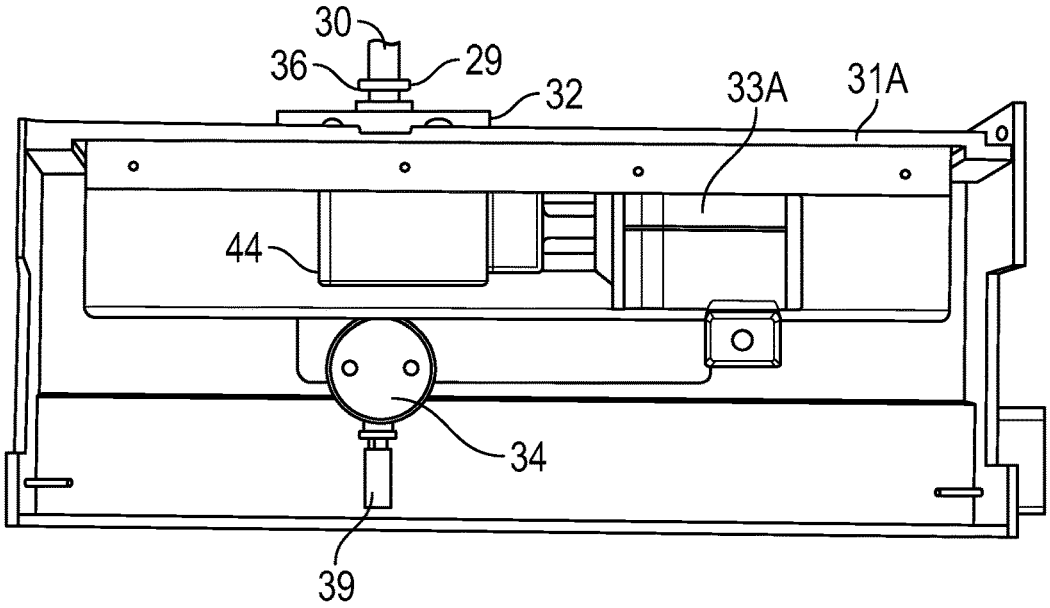
FIG. 5B illustrates a filter interfacing with a fluid supply line, and a spray wand and spray wand base within the base, in accordance with features of an embodiment.

FIGS. 5A-5B illustrate drawings of components included in/with a rotation motor housing 31A. Major components included in the rotation motor housing 31A include a rotation motor 33A, a water filter 34, and a water supply line 35. During operation, fluid (for example water) can be pumped from an external pumping source, or alternatively from the reservoir 21, into the high pressure hose connector 39 through the rotary union to the water filter 34, and through the spray wand adaptor base 36, which runs through the center of the rotation gearbox 44 into a spray wand 30.

The spray wand 30 can be firmly attached to the spray wand adaptor base 36 with tri-clamp 29 or other style connection method. The rotation motor housing 31A can be attached to the base 19 in a manner that allows the rotation motor housing 31A with wand 30 to be moved out of the way, between the cavity mounting plate 26 and the carriage adapter mount to allow the cavity mounting plate 26 to be lowered, so that a cavity can be installed or removed without interference from the spray wand 30. This is more fully detailed in FIGS. 12-13.

Figure 6A:
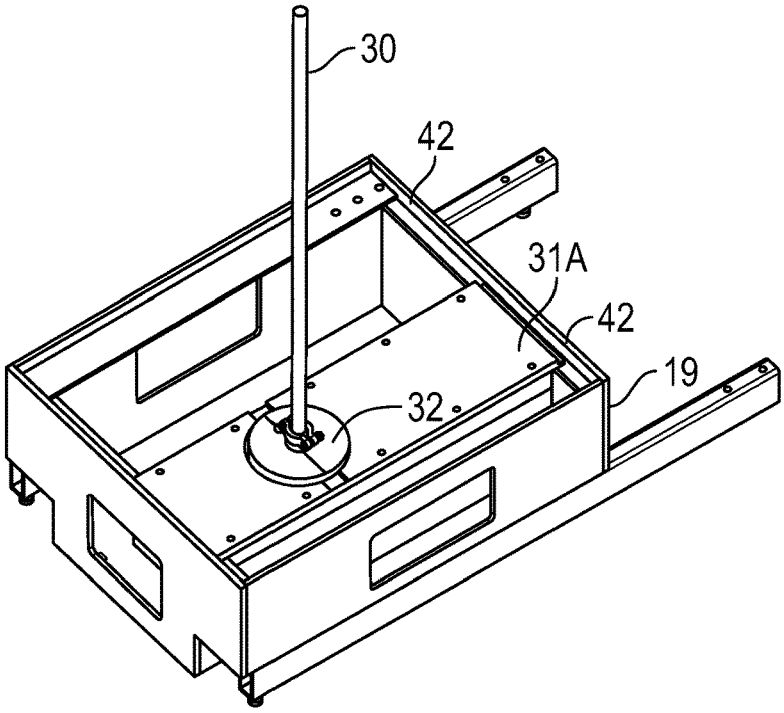
FIG. 6A illustrates a spray wand installed within the base, in accordance with features of the embodiments.
Figure 6B:
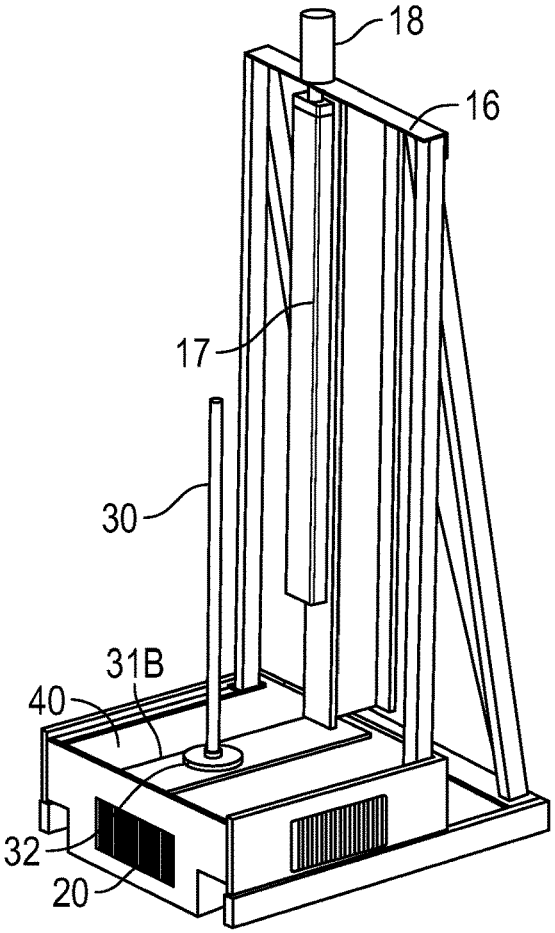
FIG. 6B illustrates a rotation motor housing and spray wand installed within the base, in accordance with features of the embodiments.
Figure 7A:
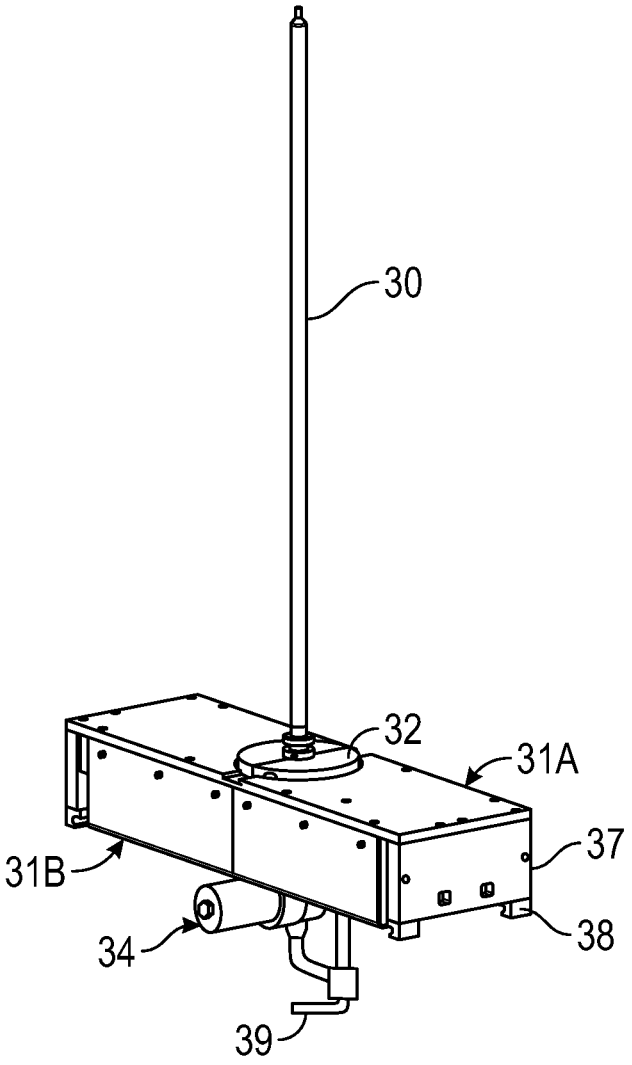
FIG. 7A illustrates drawings of a spray wand and associated components including a rotation motor housing containing a water filter, in accordance with features of the embodiments.
Figure 7B:
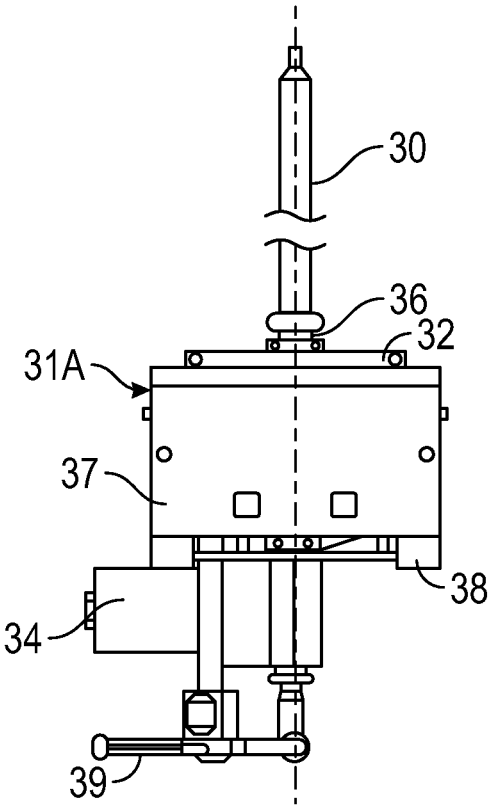
FIG. 7B illustrates drawings of a spray wand and associated components including a rotation motor housing containing a water filter, in accordance with features of the embodiments.
Figure 7C:
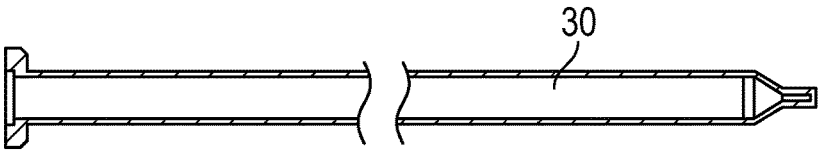
FIG. 7C illustrates a spray wand, in accordance with features of the embodiments.
Figure 7D:
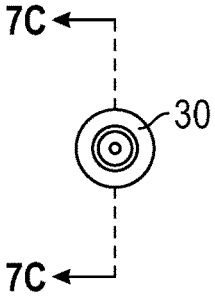
FIG. 7D illustrates a spray wand, in accordance with features of the embodiments.
Figure 7E:
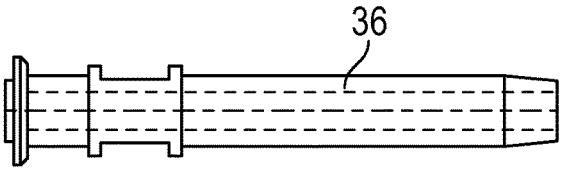
FIG. 7E illustrates a spray wand adaptor base, in accordance with features of the embodiments.
Figure 7F:
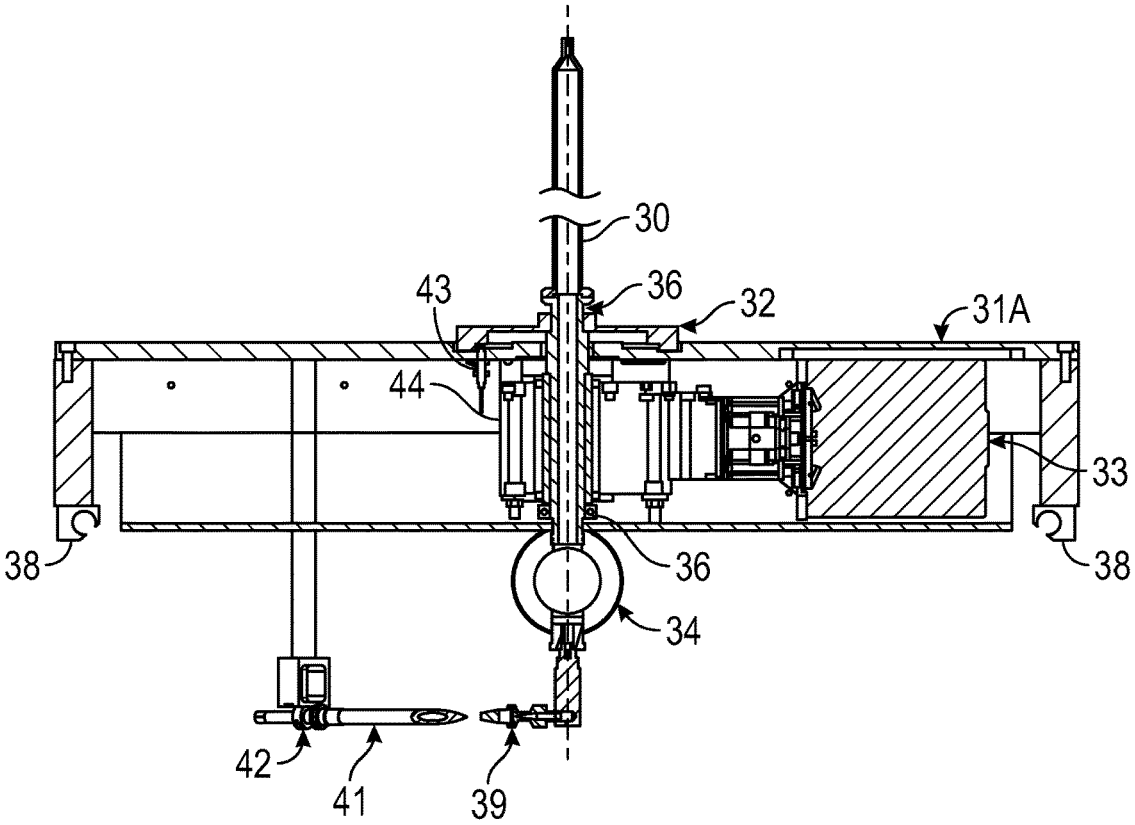
FIG. 7F illustrates a spray wand and associated components including a rotation motor housing containing a water filter, in accordance with features of the embodiments.

FIG. 6A and FIG. 6B illustrate that floor grates 40 can optionally be provided if an embodiment does not include movement of the rotation motor housing 31A to limit splash back from water dropping back into the water reservoir 21 from the HPR system 10 enclosure and subject cavity 27. The reservoir 21 can thus serve as a catch basin for water draining off or out of the cavity 27. The spray wand 30 is shown installed on the rotation motor housing 31A, which is then installed in the base 19 as shown in FIG. 6B.

FIGS. 7A-7F illustrate a spray wand 30 and associated components including a rotation motor housing 31A containing a rotation motor 33 and rotation gearbox 44, and a water filter 34 connected between a high pressure hose connector 39 and a spray wand adapter base 36. The spray wand 30 is shown attached to the rotation gearbox 44 via a spray wand adapter base 36. A guide rail bearing 38 can be mounted to the bearing mounting plate 37.

A splashguard assembly 32 is shown located where the spray wand 30 penetrates the rotation motor housing 31A through the spray wand adapter base 36. The splashguard assembly 32 and spray wand adapter base 36 can operate to keep water out of the rotation motor housing 31A. Water can be supplied from a high-pressure hose 41 to the rotary union. In such an embodiment, the high-pressure hose 41 can be suspended by a high-pressure hose mount 42 to minimize movement of the hose during initiation of pumping, or during operation, reducing stress on the rotary union. A proximity switch 43 can be included with the rotation motor housing 31A to detect the rotation of the spray wand adapter base 36 and connected components to ensure rotation is correct.

Figure 8A:
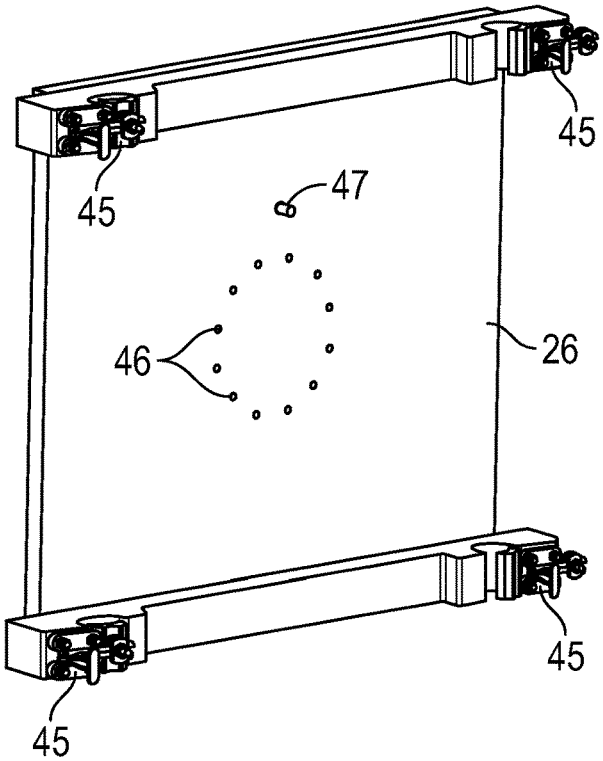
FIG. 8A illustrates a cavity grip assembly, including a bearing and locking pin, to allow rotation indexing of a plate, in accordance with features of the embodiments.
Figure 8B:
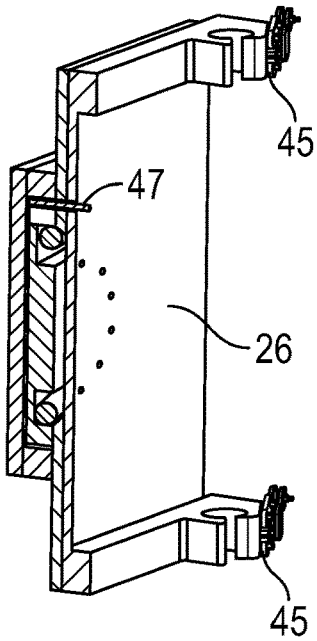
FIG. 8B illustrates a cavity grip assembly, including a bearing and locking pin, to allow rotation indexing of a plate, in accordance with features of the embodiments.
Figure 8C:
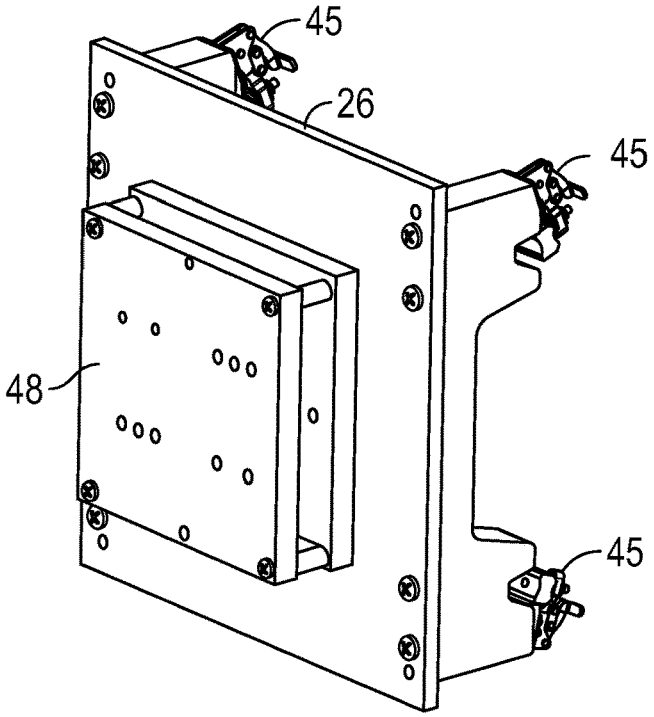
FIG. 8C illustrates a cavity grip assembly, including a bearing and locking pin, to allow rotation indexing of a plate, in accordance with features of the embodiments.

Referring to FIGS. 8A-8C, a cavity grip assembly is illustrated, in accordance with features of the embodiments. As described with respect to FIGS. 3A-3B, subject cavity 27 (or other such component requiring cleaning/rinsing), can be suspended from a cavity mounting plate 26 by a cavity-holding frame 28. The cavity-holding frame 28 and subject cavity 27 can be held to the cavity mounting plate 26 by cavity frame clamps 45. A spring plunger 47 enables the cavity mounting plate 26 to be rotated as needed and locked into position. This is further facilitated with rotary grip assembly 46. The cavity mounting plate 26 can rotate so that a subject cavity 27 can be washed and rinsed from different directions. A carriage adapter mount 48 can be provided to secure the cavity mounting plate 26 to the linear rail 17.

Figure 9A:
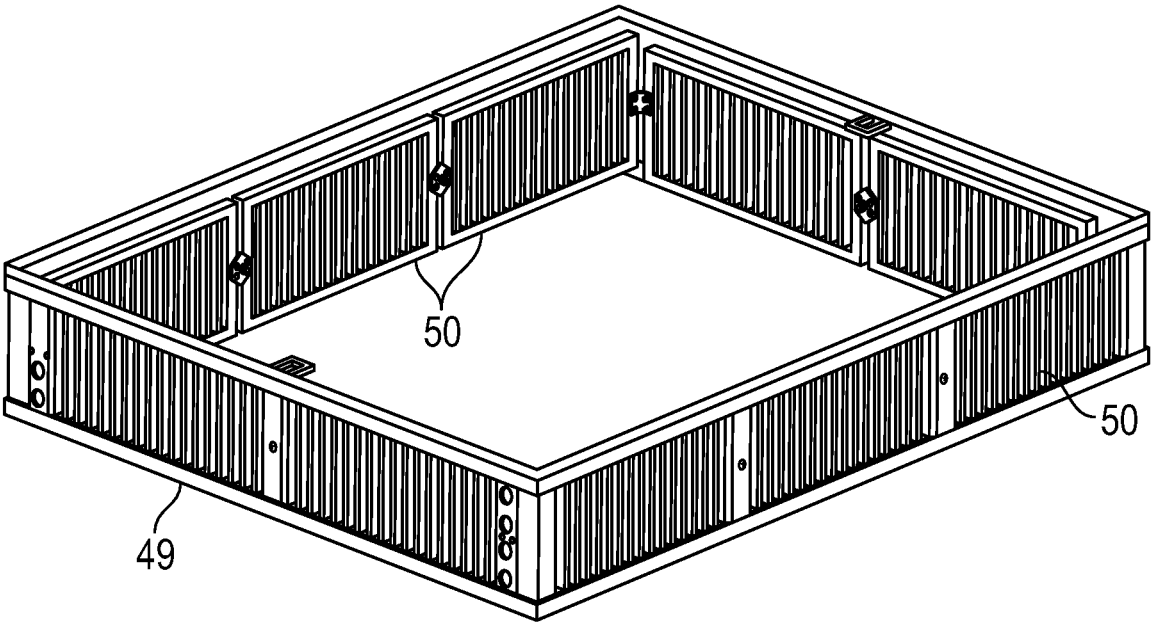
FIG. 9A illustrates a filter assembly, in accordance with features of the embodiments.
Figure 9B:
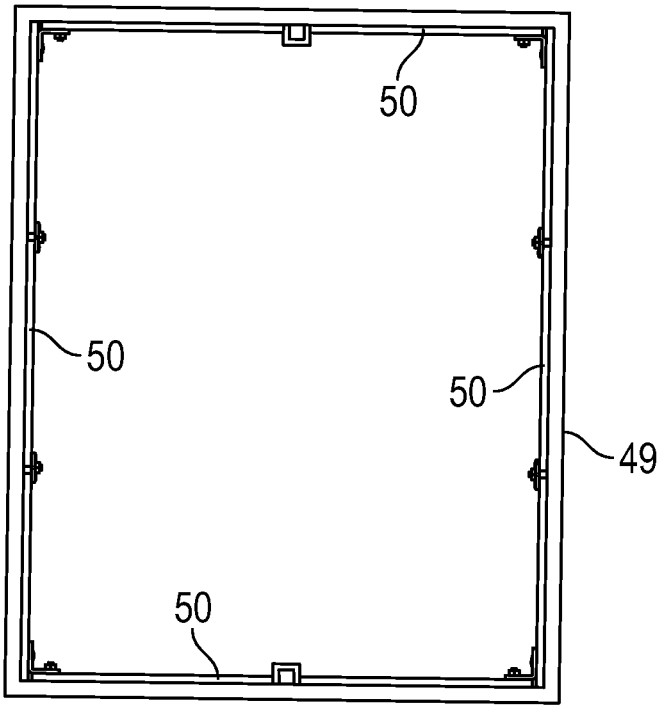
FIG. 9B illustrates a filter assembly, in accordance with features of the embodiments.

Referring to FIGS. 9A-9B, a filter assembly is illustrated, in accordance with features of the embodiments. A filter assembly can include a filter housing 49 and filters 50. The filters 50 can be mounted on the filter housing 49. The filter housing 49 can be mounted at the interior of the base above the water reservoir 21 to filter air flowing through the HPR system 10 and out to the environment while keeping water and mist inside. This is important where the surrounding environment is a clean room environment requiring minimal contamination from equipment such as the HPR system 10.

Figure 10A:
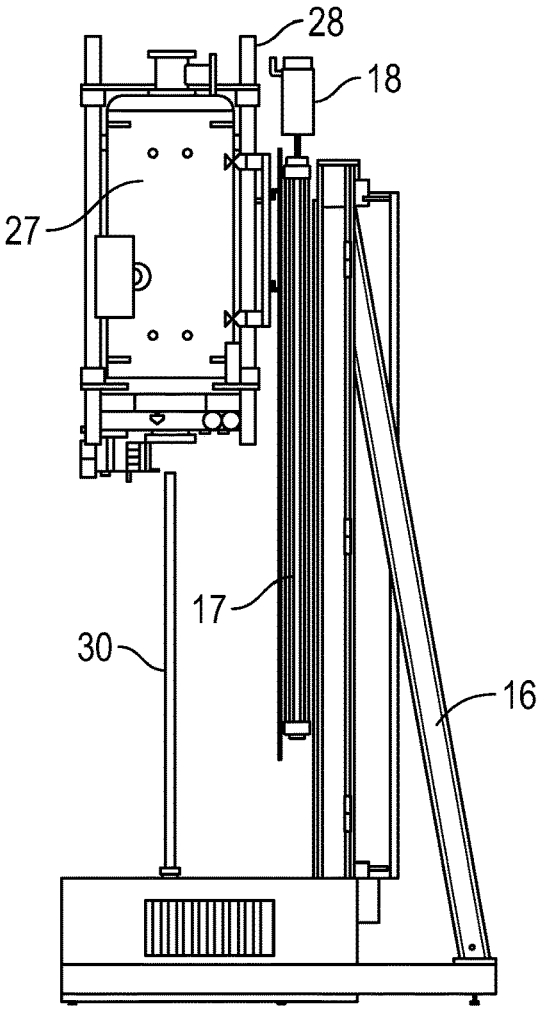
FIG. 10A illustrates a high-powered rinsing system during operation with a cavity ready for placement over a spray wand, in accordance with features of the embodiments.
Figure 10B:
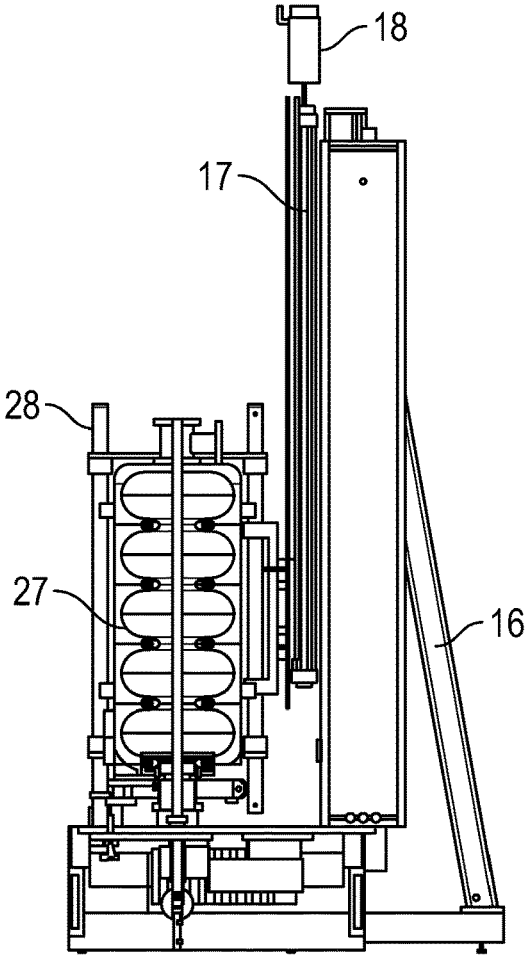
FIG. 10B illustrates a high-powered rinsing system during operation with a cavity placed over a wand, in accordance with features of the embodiments.

FIGS. 10A-10B, illustrate two conditions for the HPR system 10 during operation, in accordance with features of the embodiments. FIG. 10A depicts an HPR system 10 during operation with a subject cavity 27 at a first instance. In this drawing, the cavity 27 is mounted in the HPR system 10 and is ready for movement over a spray wand 30. FIG. 10B is a depiction of the HPR system 10 during operation with the subject cavity 27 at a second instance where it is placed over a spray wand 30. At this instance, the cavity 27 is undergoing cleansing/rinsing operations via cleaning fluid delivered from the spray wand 30.

Figure 11:
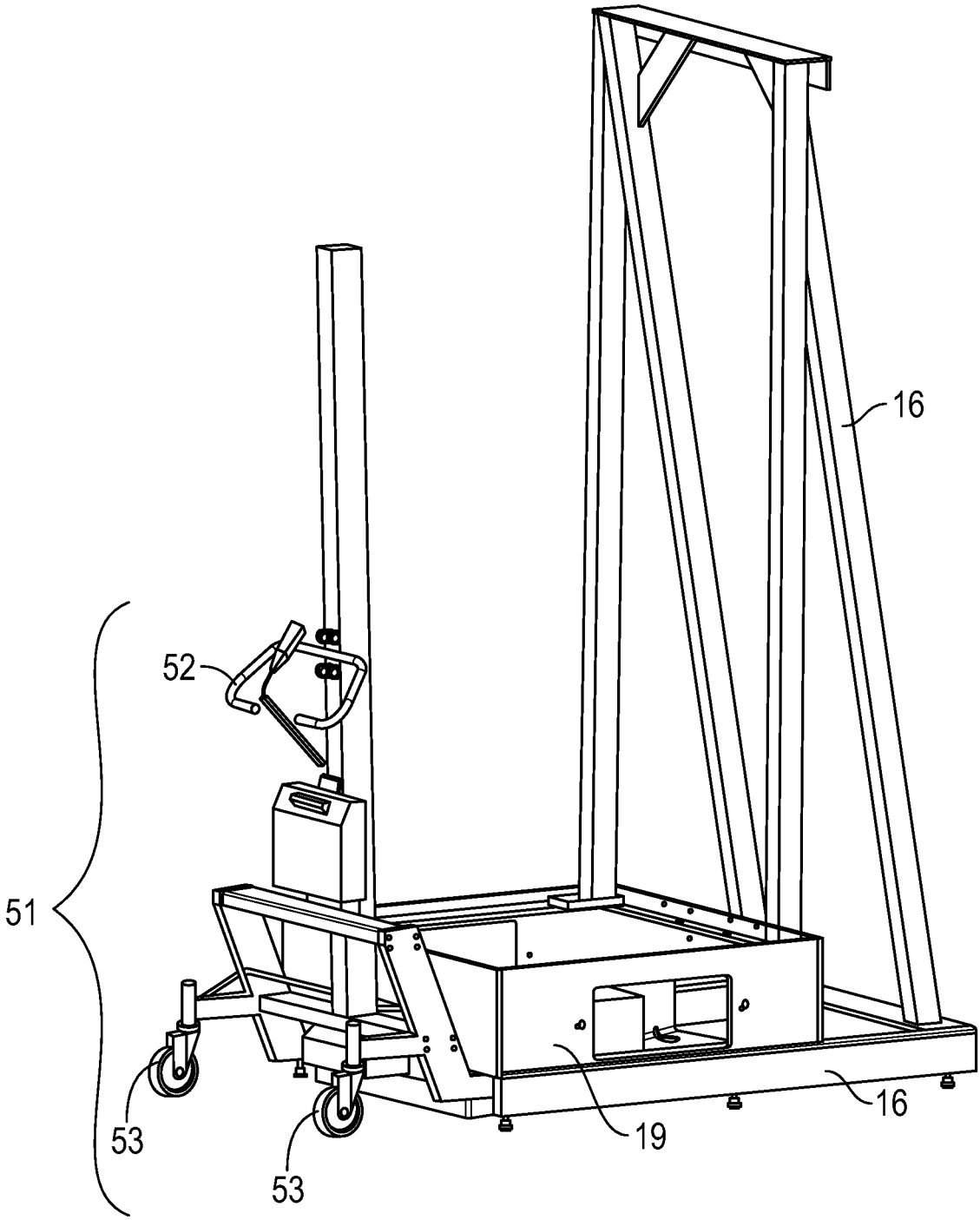
FIG. 11 illustrates an embodiment of a high-powered rinsing system including a tote assembly, to enable movement of the system, in accordance with features of the embodiments.

Referring to FIG. 11, the frame 16 and base 19 of the HPR system 10 are illustrated (without an enclosure for example only). In this embodiment, a tote assembly 51 is shown. The tote assembly 51 is configured to enable movement of the HPR system 10 around an industrial setting. The tote assembly 51 can include a handle 52 and wheels 53, which can be manipulated by a user to move the HPR system 10 over flooring within an industrial environment.

FIG. 12A-12D illustrate embodiments of an HPR system 10 in a stowed position with the spray wand 30 behind the cavity mounting plate 26, prior to operation, in order to facilitate attachment of a subject cavity 27 to the cavity mounting plate 26.

Figure 12A:
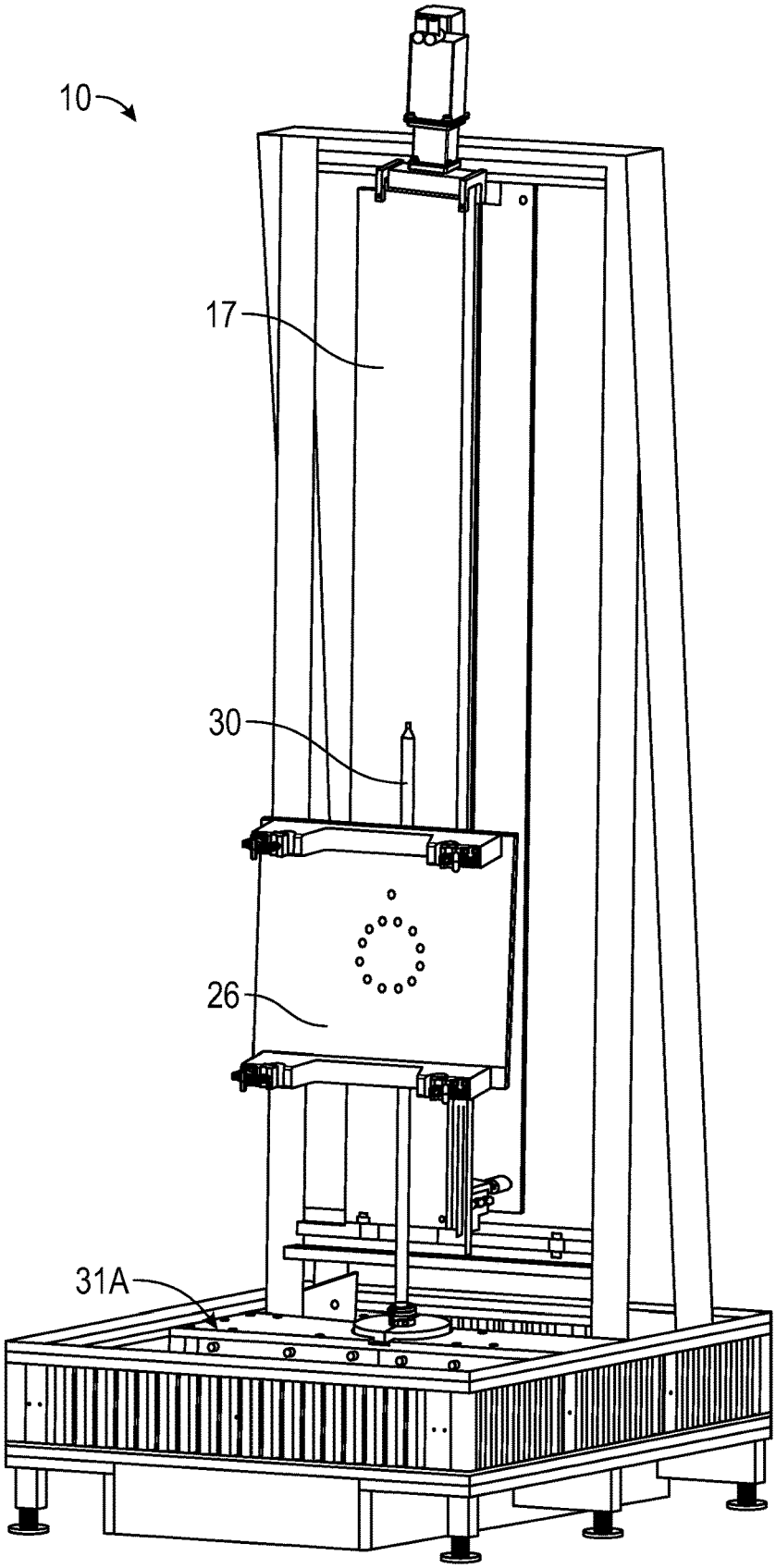
FIG. 12A illustrates an embodiment of an HPR system showing a stowed position for the spray wand behind the cavity mounting plate prior to operation in order to facilitate attachment of a subject cavity to the cavity mounting plate, in accordance with features of the embodiments.
Figure 12B:
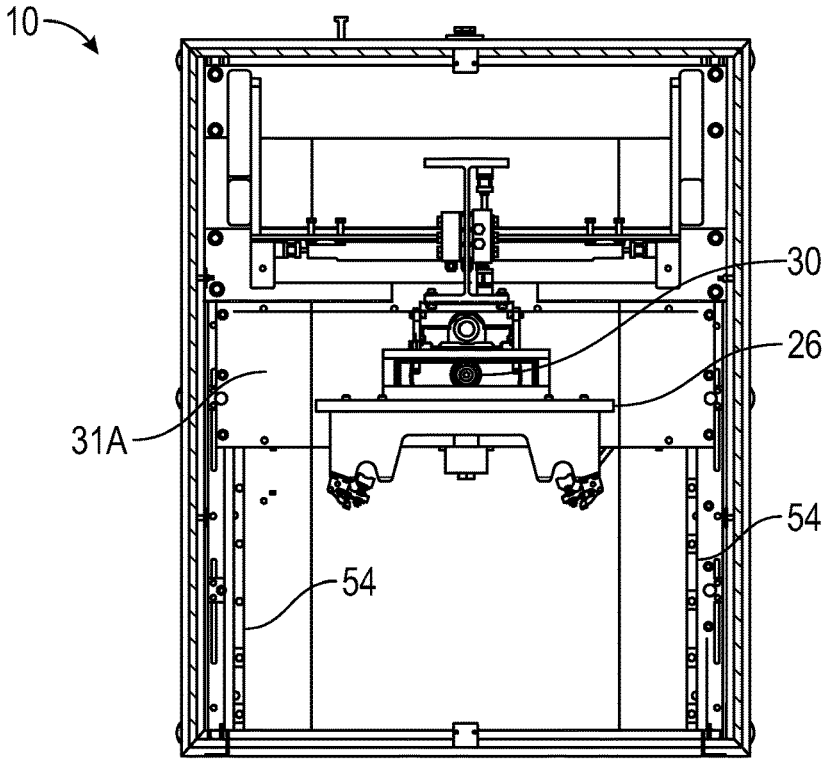
FIG. 12B illustrates an embodiment of an HPR system showing a stowed position for the spray wand behind the cavity mounting plate prior to operation in order to facilitate attachment of a subject cavity to the cavity mounting plate, in accordance with features of the embodiments.
Figure 12C:
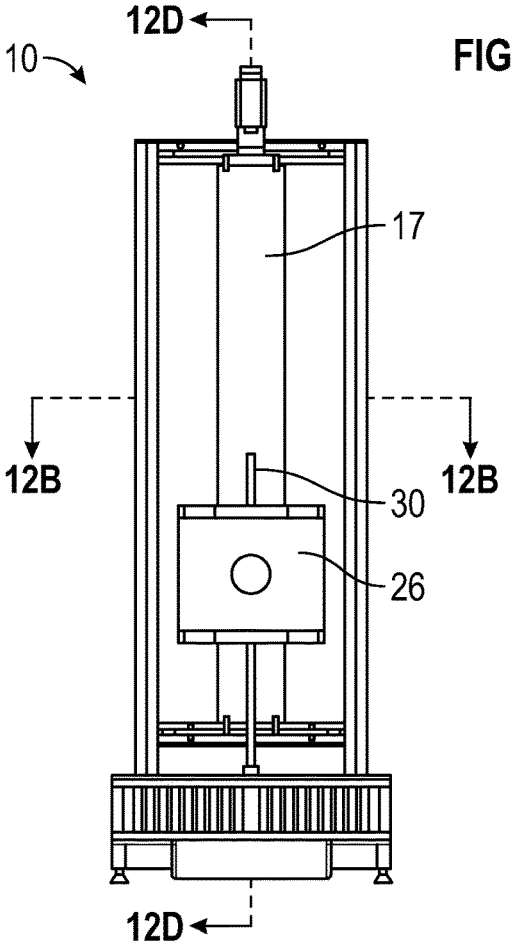
FIG. 12C illustrates an embodiment of an HPR system showing a stowed position for the spray wand behind the cavity mounting plate prior to operation in order to facilitate attachment of a subject cavity to the cavity mounting plate, in accordance with features of the embodiments.
Figure 12D:
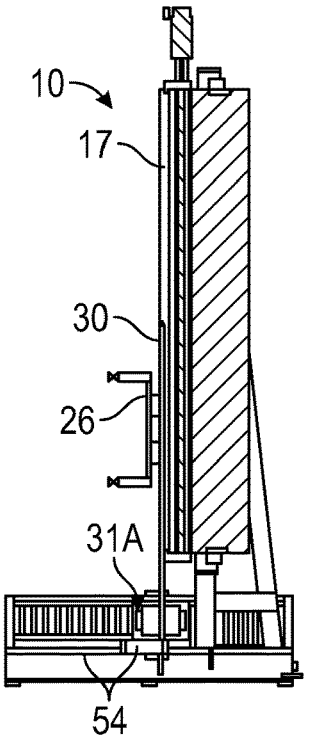
FIG. 12D illustrates an embodiment of an HPR system showing a stowed position for the spray wand behind the cavity mounting plate prior to operation in order to facilitate attachment of a subject cavity to the cavity mounting plate, in accordance with features of the embodiments.

FIG. 12A provides a three-point perspective view showing the spray wand 30 located behind the cavity mounting plate 26. FIG. 12B is a top view showing the spray wand 30 located behind the cavity mounting plate 26. FIG. 12C is a front view showing the spray wand 30 located behind the cavity mounting plate 26. FIG. 12D is a right side view showing the spray wand 30 located behind the cavity mounting plate 26.

Location of the spray wand 30 behind the cavity mounting plate 26 eases the operation of attaching the subject cavity 27 to the cavity mounting plate 26 because the spray wand 30 is out of the way during the mounting operation. Once a cavity is mounted, it can be raised upward along the linear rail 17 so that the spray wand 30 can be moved forward (and directly underneath the subject cavity 27). Forward and backward movement of the spray wand 30 can be facilitated by movement of the rotation motor housing 31A, which can be mounted to a horizontal track and motor system 54.

FIG. 13A-13D illustrate another embodiment of the HPR system 10, showing an operational position for the spray wand 30 in front of the cavity mounting plate 26, and as it would located be when located within a subject cavity 27 (not shown) during operation (after attachment of a subject cavity 27 to the cavity mounting plate 26), in accordance with features of the embodiments.

Figure 13A:
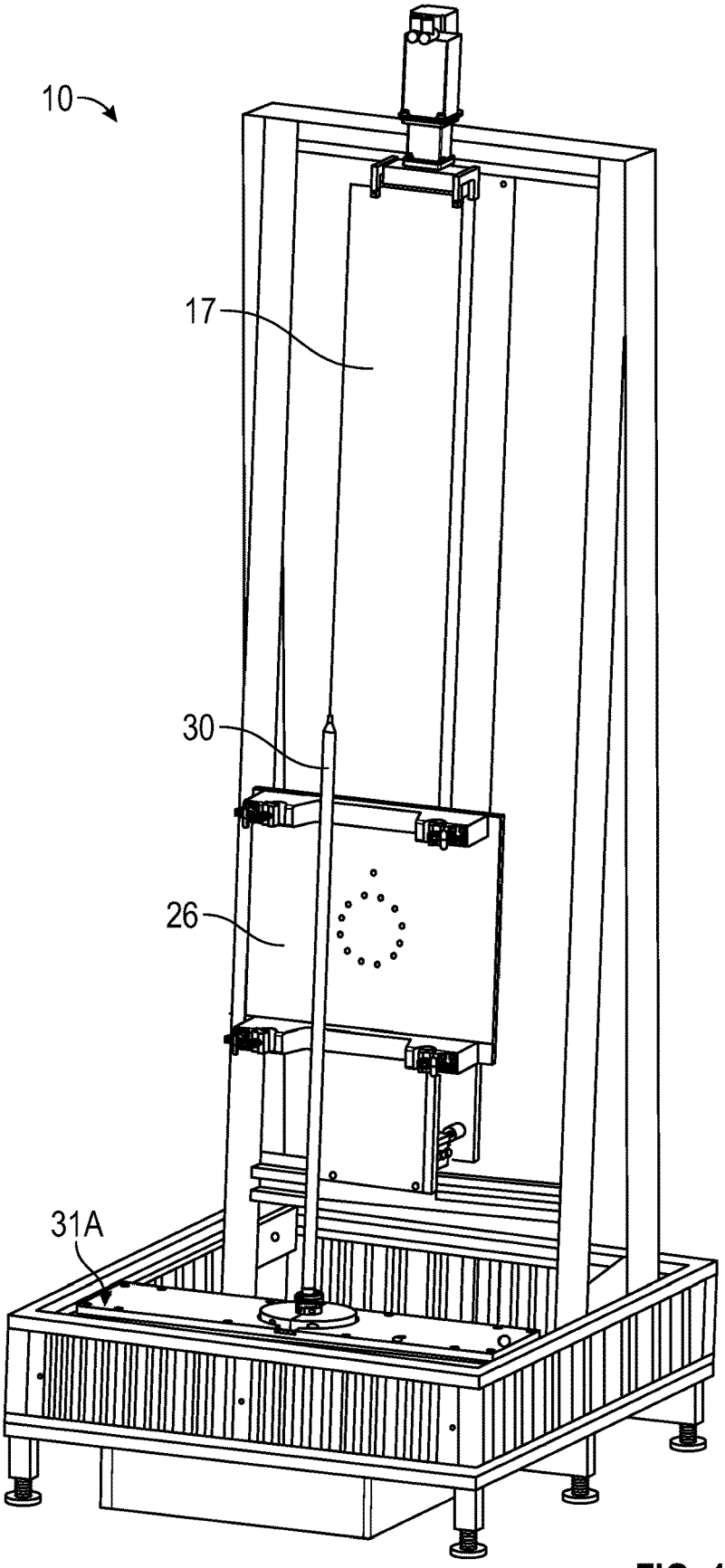
FIG. 13A illustrates another embodiment of an HPR system 10 showing an operational position for the spray wand in front of the cavity mounting plate, and as it would located within a subject cavity (not shown) during operation (after attachment of a subject cavity to the cavity mounting plate), in accordance with features of the embodiments.
Figure 13B:
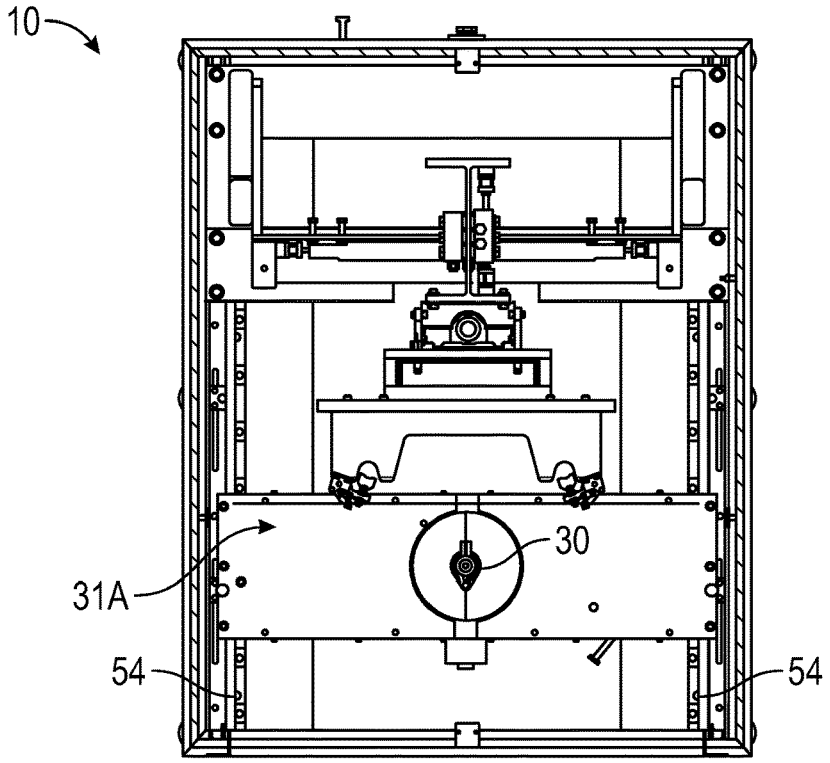
FIG. 13B illustrates another view of an HPR system 10 showing an operational position for the spray wand in front of the cavity mounting plate, and as it would located be when located within a subject cavity (not shown) during operation—after attachment of a subject cavity to the cavity mounting plate, in accordance with features of the embodiments.
Figure 13C:
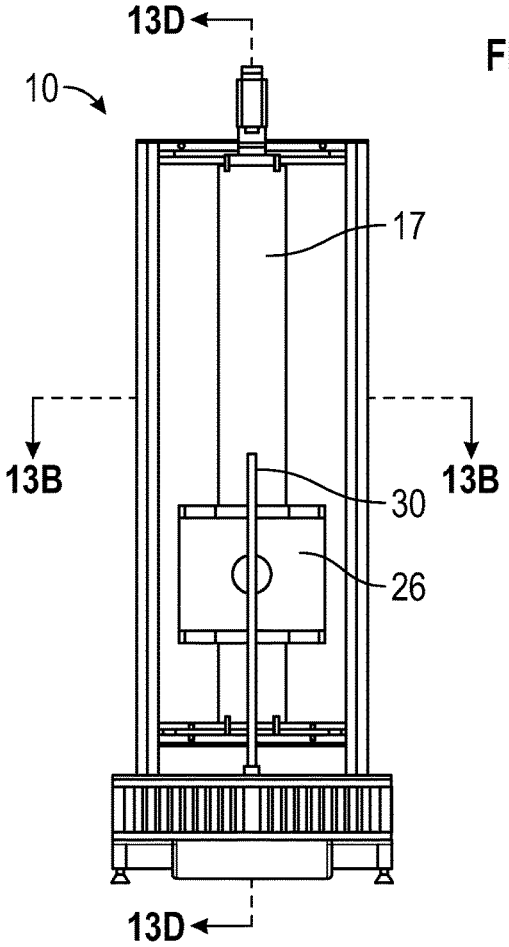
FIG. 13C illustrates another view of an HPR system 10 showing an operational position for the spray wand in front of the cavity mounting plate, and as it would located be when located within a subject cavity (not shown) during operation—after attachment of a subject cavity to the cavity mounting plate, in accordance with features of the embodiments.
Figure 13D:
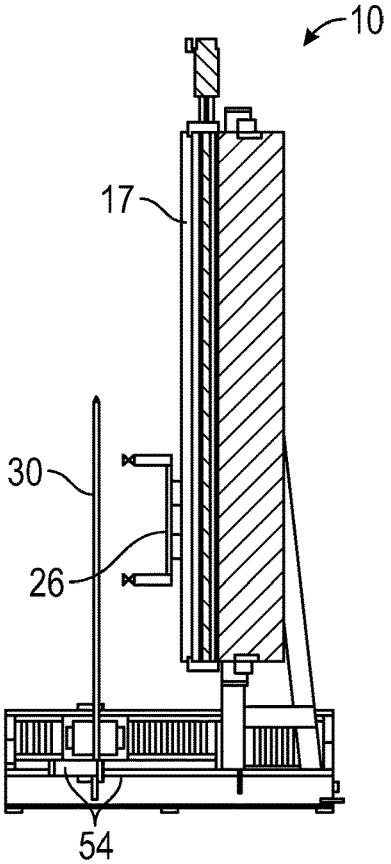
FIG. 13D illustrates another view of an HPR system 10 showing an operational position for the spray wand in front of the cavity mounting plate, and as it would located be when located within a subject cavity (not shown) during operation—after attachment of a subject cavity to the cavity mounting plate, in accordance with features of the embodiments.

FIG. 13A provides a three-point perspective view showing the spray wand 30 located in front of the cavity mounting plate 26. FIG. 13B is a top view showing the spray wand 30 located in front of the cavity mounting plate 26. FIG. 13C is a front view showing the spray wand 30 located in front of the cavity mounting plate 26. FIG. 13D is a right side view showing the spray wand 30 located in front of the cavity mounting plate 26. When a subject cavity 27 is mounted to the cavity mounting plate 26, its interior would surround the spray wand 30 (similar to the configurations illustrated in FIGS. 3A-3B).

The disclosed system is designed so that it can be used as a class 10 clean room device. Clean room environments must remain clear of contaminants, therefore a self-contained, or water tight, system is important to achieve low or no contamination if there are no other provisions designed into the cleanroom.

Based on the foregoing, it can be appreciated that a number of embodiments, preferred and alternative, are disclosed herein. For example, in one embodiment, a rinsing system comprises a linear rail, a cavity-holding frame engaged with the linear rail, the cavity-holding frame being configured to engage with a cavity, a spray wand fluidically connected to a fluid source, a rotation motor configured to rotate the spray wand, a pump motor configured to deliver fluid to the spray wand, and an enclosure configured to prevent the fluid delivered from the spray wand from exiting the rinsing system.

In an embodiment, the rinsing system further comprises a vertical motor operably engaged to the linear rail wherein the vertical motor can raise and lower the linear rail. In an embodiment, the rinsing system further comprises a linear rail support frame associated with the linear rail.

In an embodiment, the rinsing system further comprises a cavity mounting plate for mounting the cavity to the cavity-holding frame. In an embodiment, the cavity mounting plate further comprises at least one cavity frame clamp for joining the cavity to the cavity-holding frame. In an embodiment, the cavity mounting plate further comprises a spring plunger for rotating the cavity mounting plate. In an embodiment the system further comprises a carriage adapter mount configured to connect the cavity mounting plate to the linear rail.

In an embodiment, the rinsing system further comprises at least one door, a plurality of side panels, and a base. In an embodiment, the base houses a fluid reservoir, a rotation motor housing, that houses the rotation moto, and a spray wand adaptor plate that interfaces the spray wand with a rotation gear box.

In another embodiment, a high-pressure rinsing system, comprises a base including at least one of adjustable feet and/or wheels adapted to contact a floor, the base including a liquid reservoir for process water collection, a rotation motor housing including a rotation motor attached to a rotation gearbox and a pump motor adapted to pump water from a through hose and rotary union to a filter housing through the rotation gearbox through a spray wand adapter base to a spray wand attached, and extending vertically upward from, the rotation motor housing and base, a linear rail support frame attached the base and including a vertical motor and associated linear rail attached thereto, wherein the vertical motor is adapted to move the linear rail, a cavity mounting plate attached to the linear rail, wherein vertical movement of the linear rail causes vertical movement of the cavity mounting plate, and at least one door and a plurality of side panels mounted to an enclosure support frame, wherein the enclosure support frame is engaged to the linear rail support frame and base to create an enclosure around the spray wand and the linear rail.

In an embodiment of the high-pressure rinse system, the cavity mounting plate is further adapted to be mounted to a subject cavity. In certain embodiments, the spray wand can be moved behind the cavity mounting plate to allow a cavity and cavity-holding frame to be installed or removed without removal of the spray wand. In certain embodiments the at least one door further comprises at least one handle adapted to open and close the at least one door and at least one latch to keep the at least one door closed to create the water tight enclosure. In certain embodiment the high-pressure rinsing further comprises a horizontal track and motor system adapted to facilitate forward and backward movement of the rotation motor housing and spray wand with respect to the cavity mounting plate position.

In another embodiment, a system comprises a housing comprising at least one door, a plurality of panels, and a base, a linear rail supported by a linear rail support frame within the housing, a vertical motor mounted to the linear rail support frame and configured to raise and lower the linear rail, a cavity-holding frame configured to hold a cavity, a spray wand adapted to deliver cleaning fluid, a rotation motor configured to rotate the spray wand, and an external pump motor configured to deliver fluid to the spray wand.

In an embodiment, the system further comprises a tote assembly engaged to the linear rail support frame, the tote assembly further comprising: at least one wheel and an operator handle.

In an embodiment the system further comprises a rotation motor housing for housing the rotation motor; and a pump motor wherein the spray wand can be mounted to the rotation motor housing with a spray wand base adaptor. In an embodiment, the rotation motor housing is mounted in the base. In an embodiment, a track and motor system can be mounted in the base and configured to adjust the position of the rotation motor housing in the base, such that spray wand can be moved behind the cavity mounting plate.

In an embodiment, the system further comprises a cavity mounting plate associated with the cavity-holding frame wherein the cavity mounting plate and cavity-holding frame are adapted to hold an accelerator cavity.

It will be appreciated that variations of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art which are also intended to be encompassed by the following claims.

What is claimed is:

1. A rinsing system comprising:
a linear rail;
a cavity-holding frame engaged with the linear rail, the cavity-holding frame being configured to engage with a cavity;
a spray wand fluidically connected to a fluid source;
a rotation motor configured to rotate the spray wand;
a vertical motor operably engaged to the linear rail wherein the vertical motor can raise and lower the linear rail; and
an enclosure configured to prevent the fluid delivered from the spray wand from exiting the rinsing system.

2. The rinsing system of claim 1 further comprising:
a linear rail support frame associated with the linear rail.

3. The rinsing system of claim 1 further comprising:
a cavity mounting plate for mounting the cavity to the cavity-holding frame.

4. The rinsing system of claim 3 wherein the cavity mounting plate further comprises:
at least one cavity frame clamp for joining the cavity to the cavity-holding frame.

5. The rinsing system of claim 3 wherein the cavity mounting plate further comprises:
a spring plunger configured to lock and release rotation of the mounting plate.

6. The rinsing system of claim 3 further comprising:
a carriage adapter mount configured to connect the cavity mounting plate to the linear rail.

7. The rinsing system of claim 1 further comprising:
a pump motor configured to deliver fluid to the spray wand.

8. The rinsing system of claim 1 further comprising:
at least one door;
a plurality of side panels; and
a base wherein the base houses:
- a fluid catch basin;
- a rotation motor housing, that houses the rotation motor; and
- a spray wand adaptor plate that interfaces the spray wand with a rotation gear box.

* * * * *